US010995438B2

(12) United States Patent
Alon et al.

(10) Patent No.: US 10,995,438 B2
(45) Date of Patent: May 4, 2021

(54) INTEGRATED SYSTEM AND METHOD FOR TREATING A THREAD AND USING THEREOF

(71) Applicant: Twine Solutions Ltd., Petach Tiqva (IL)

(72) Inventors: Moshe Alon, Petach Tiqva (IL); Erez Moshe, Zichron Yaakov (IL); Alon Navon, Even Yehuda (IL); Yoram Zilberberg, Tel Aviv (IL)

(73) Assignee: Twine Solutions Ltd., Petach Tiqva (IL)

( * ) Notice: Subject to any disclaimer, the term of this patent is extended or adjusted under 35 U.S.C. 154(b) by 35 days.

(21) Appl. No.: 15/745,946

(22) PCT Filed: Jul. 20, 2016

(86) PCT No.: PCT/IL2016/050789
§ 371 (c)(1),
(2) Date: Jan. 18, 2018

(87) PCT Pub. No.: WO2017/013651
PCT Pub. Date: Jan. 26, 2017

(65) Prior Publication Data

US 2018/0216273 A1 Aug. 2, 2018

Related U.S. Application Data

(60) Provisional application No. 62/194,940, filed on Jul. 21, 2015.

(51) Int. Cl.
*D05B 65/06* (2006.01)
*D05C 11/24* (2006.01)
(Continued)

(52) U.S. Cl.
CPC ..... *D05B 65/06* (2013.01); *D05B 19/12* (2013.01); *D05B 67/00* (2013.01); *D05C 11/24* (2013.01); *D05C 13/02* (2013.01); *D05D 2305/22* (2013.01)

(58) Field of Classification Search
CPC ..... D05B 67/00; D05B 65/06; D05B 19/12; D05C 11/24; D05C 13/02
(Continued)

(56) References Cited

U.S. PATENT DOCUMENTS 2,844,016 A 7/1958 Cobert
3,981,255 A * 9/1976 Taylor ..... D05B 25/00 112/155
(Continued)

FOREIGN PATENT DOCUMENTS

CN 201901758 U 7/2011
EP 0643005 A1 3/1995
(Continued)

OTHER PUBLICATIONS

International Search Report and Written Opinion for corresponding PCT App. No. PCT/IL2016/050789 dated Dec. 19, 2016.
(Continued)

*Primary Examiner* — Alissa L Hoey
*Assistant Examiner* — Patrick J. Lynch
(74) *Attorney, Agent, or Firm* — The Roy Gross Law Firm, LLC; Roy Gross

(57) ABSTRACT

An integrated system for treating a thread and using the treated thread, comprising: a thread treatment machine for treating a thread or portions thereof; a thread applicator configured for using the treated thread such as a stitching machine of 3D printer; at least one mechanism for collecting and trimming thread portions; and a control unit, configured for controlling at least the thread treatment machine, the
(Continued)

thread applicator and the collecting and trimming mechanism and for coordinating the treatment of the thread with the operation of the thread applicator, wherein the control unit is further configured for controlling the collecting and trimming mechanism for collecting untreated thread edge portions for allowing using only treated thread portions.

14 Claims, 7 Drawing Sheets

(51) Int. Cl.
*D05B 19/12* (2006.01)
*D05B 67/00* (2006.01)
*D05C 13/02* (2006.01)

(58) Field of Classification Search
USPC ..... 112/80.7, 80.71, 470.01, 470.02
See application file for complete search history.

(56) References Cited

U.S. PATENT DOCUMENTS

| | | | | | |
|---|---|---|---|---|---|
| 4,380,961 | A | | 4/1983 | Reinert et al. | |
| 4,453,477 | A | * | 6/1984 | Gerber | D05B 51/00 112/102.5 |
| 4,461,229 | A | | 7/1984 | Angele et al. | |
| 4,475,474 | A | * | 10/1984 | von Hagen | D05B 35/06 112/152 |
| 4,630,364 | A | * | 12/1986 | Fyfe | A41H 37/00 112/104 |
| 5,143,004 | A | * | 9/1992 | Mardix | D05B 59/04 112/180 |
| 5,603,462 | A | * | 2/1997 | Conrad | B65H 69/00 112/254 |
| 5,671,614 | A | * | 9/1997 | Shima | D05C 11/24 66/13 |
| 6,189,989 | B1 | | 2/2001 | Hirabayashi et al. | |
| 2003/0135931 | A1 | * | 7/2003 | Shaw | B65H 71/007 8/115.6 |
| 2007/0245940 | A1 | * | 10/2007 | Wahlstrom | D05B 67/00 112/270 |
| 2013/0135931 | A1 | | 7/2013 | Shaw | |
| 2015/0040810 | A1 | * | 2/2015 | Kongo | D05B 19/08 112/470.02 |

FOREIGN PATENT DOCUMENTS

| | | | |
|---|---|---|---|
| EP | 0743385 | A2 | 11/1996 |
| GB | 754618 | A | 8/1956 |
| JP | 1987215037 | | 9/1987 |
| JP | 1995080175 | | 3/1995 |
| JP | 08311753 | | 11/1996 |
| JP | 2012-513817 | | 6/2012 |
| JP | 2014-532121 | | 12/2014 |
| WO | 200112891 | A1 | 2/2001 |
| WO | 2001036732 | A1 | 5/2001 |
| WO | 2010076823 | A1 | 7/2010 |
| WO | 2013039447 | A1 | 3/2013 |

OTHER PUBLICATIONS

International Preliminary Report on Patentability for corresponding PCT App. No. PCT/IL016/050789 dated Jan. 23, 2018.

Office Action for corresponding Japanese Application No. 2018-522892 dated Sep. 29, 2020.

* cited by examiner

INTEGRATED SYSTEM AND METHOD FOR TREATING A THREAD AND USING THEREOF

FIELD OF THE INVENTION

The present invention generally relates to devices, apparatuses, systems and methods for treating a thread and using the treated thread for another thread applicator such as a stitching or a three-dimensional (3D) printer using filament threads and for advancing the thread.

BACKGROUND OF THE INVENTION

Thread applicators such as stitching machines and 3D printers using one or more threads for stitching or embroidering therewith or for 3D printing typically require placing one or more thread spools in designated spool holders for utilizing thereof, wherein the advancing of each thread from each spool is done by specifically pulling the desired thread from its spool. In case of a stitching machine such as a sewing machine, embroidery, quilting or other, for instance, using one or more stitching needles each needle is carrying out the thread pulling work by the vertical displacement thereof for stitching such that the displacement of the needle downwardly for punctuating the fabric and stitching the thread thereto also pulls the thread to be stitched from its respective thread spool.

FIG. 1 (prior art) for instance shows a part of a known in the art industrial embroidery machine 90 having multiple threading units each unit having a needle 91 through which a thread of a specific color is threaded and a holder member 92 having an opening therein for allowing the needle 91 to pass therethrough for stitching over a fabric placed below the holder member 92 and held thereby, while a boat shuttle or rotating hook bobbin (not shown) located thereunder is used to produce the actual lock-stitching as known in the art. The embroidery machine also includes a clamp device 93 pivotally movable about an axis for gripping the thread and keeping the tension in the thread. The clamp device 93 includes a mechanism for clamping or gripping the thread such as hook-and-loop fastener strips (e.g. VELCRO™ strips). A fixated thread collecting member 94 may extend from the clamp device 93 for hooking the thread and pulling thereof into the clamp device 93.

FIG. 2 (prior art) shows a rotating hook bobbin 82 operation for producing lock-stitches by having the needle 91 of the stitching machine having the main thread 41 threaded through a needle hole thereof, penetrate through the fabrics 21 and 22 while the bobbin 82 grabs the main thread 41 via a clipped edge thereof, forms a loop from the grabbed piece of said main thread and interlaces it with another secondary thread 42 for forming each lock-stitch.

For creating embroidery patterns of multiple colors, the embroidery machine uses multiple main thread spools each assigned to a different needle or using a single needle requiring a human operator to replace the thread spool being used.

Thread treating machines and systems such as thread dyeing machines are often used separately even in separate factories producing spools of thread each spool containing thread of a different color tone for mass distribution thereof to the textile industry and workshops.

There are several solutions for pulling of a thread of a sewing machine for various purposes:

CN 201901758 teaches a thread pulling device for a sewing machine that has a rotatable shaft connected to a hook shaped pulling rod. The hook is located between the thread carriers and the needles.

GB 754618 teaches a thread pulling-off device, which is adapted to be operated at the beginning and end of each cycle, exerts a clamping effect on the thread temporarily whilst it is being pulled. The pulling means comprise a rotary disc, which carries a pair of diametrically opposed slotted pins constituting thread guides, and a pair of centrally-located thread-clamping jaws; the arrangement being such that, at the end of a cycle, movement of the actuating lever of a motor control switch is transmitted by means of a link, lever, slidable rod and arm secured to the latter, to the disc, whereby the thread is deflected from its straight path between the members and, whilst the jaws simultaneously close to clamp the thread therebetween.

U.S. Pat. No. 4,461,229 teaches a delivery roller located behind the needles of a sewing machine for pulling out the thread operable via drive means. A clamp is located at a different location from the roller and is designed for clamping the threads for directing and separating them from one another for having several needles stitch several threads simultaneously. The pulling of the thread(s) is done by rolling the roller.

KR 1020080093845 teaches a thread pulling apparatus for a sewing machine located between a narrow line nut and a narrow line device operable by a drive device.

U.S. Pat. No. 2,844,016 teaches a device for automatically pulling to a point offset from the needle row the portion of thread extending between the thread carrier and the fabric being knitted on a straight-bar knitting machine at the end of the operation of knitting with thread from that carrier. The thread puller has a hook located between the thread carrier and the needle such as to grab the thread for pulling it offset from the needle.

U.S. Pat. No. 4,380,961 teaches a variable pull-off mechanism for a sewing machine with a thread pull-off disc on a rotatably mounted shaft which is concentric with the drive shaft of a vertical axis looptaker. The disc is formed with thread catching edges which engage and pull-off thread from a bobbin as the disc is oscillated between a fixed and a controllable position in accordance with the operation of a servomotor responsive to various control signals.

SUMMARY OF THE INVENTION

The present invention provides an integrated system for treating a thread and using the treated thread comprising: a thread treatment machine for treating a thread or portions thereof; a thread applicator configured for using the treated thread; at least one mechanism for collecting and trimming thread portions; at least one control unit, each configured for controlling at least the thread treatment machine, the thread applicator and the collecting and trimming mechanism and for coordinating the treatment of the thread with the operation of the thread applicator, wherein the at least one control unit is further configured for controlling the collecting and trimming mechanism for collecting undesired, e.g. untreated, thread edge portions for allowing using only desired, e.g. treated, thread portions.

It should be noted that the term "undesired" means any portion or part of the thread that is not needed for the final product, i.e. will not be used by said thread applicator. Accordingly, such undesired thread portions may be either untreated thread, thread which was inadequately treated, or excess of accurately treated thread.

According to some embodiments, each collecting and trimming mechanism comprises a collecting member and a trimmer, the collecting member being configured to grab and collect the thread by having clamps rotatable by a motor about an axis thereof for collecting the thread by winding thereof.

In certain embodiments, the collecting member comprises a set of two parallel rollers, one connected to a motor (i.e. a driving roller) and the other not (i.e. a driven roller). One of the rollers is connected to an actuator to enable engagement and disengagement of the two rollers. In a specific embodiment, the collecting member further comprises a hook mechanism for grabbing the thread and placing it between said two rollers. Once the thread is placed between the two rollers, the actuator activates the roller attached thereto to engage with the other roller, such that the motor, once operated, allows the rollers to pull the thread.

In a specific embodiment, the collecting and trimming mechanism comprises two parallel rollers, at least one thereof is connected to a motor, wherein the two rollers are designed such that they can be separated from one another to allow a designated hook to pass therebetween for pulling the thread, and subsequently to reattach and hold the thread, such that when rolled, the thread is pulled. In yet another specific embodiment, the driven roller is connected to a straight slot, enabling it to both rotate freely as well as move between two positions-open and closed. At the open position the two rollers are apart from each other, and upon an order from the controller, a hook passes between the two rollers to hold the thread. After the hook returns to its original place, the thread is positioned between the two rollers, and the roller moves to the closed position. In this closed position, the two rollers are pressed against each other holding the thread firmly and the motor starts to turn, thereby pulling the thread until reaching the end of the unwanted thread segment. When reaching the end of the unwanted thread segment, the thread is trimmed and is ready for the next stage.

The integrated system optionally further comprises at least one tension control mechanism configured for maintaining tension in the thread after the thread has been treated when directed towards the thread applicator. The tension control mechanism may comprise at least one weight member pivotally connected to a fixation member, the at least one weight member being located such that the thread is held thereby such that when tension in the thread reduces the weight is lowered by gravitation thereby pulling the thread extending the thread path thereby for maintaining the tension in the thread above the minimum threshold.

The term "tension control mechanism" as used herein refers to any suitable mechanism for maintaining the tension of the thread appropriate/suitable for continuous and smooth operation of the thread applicator which receives the thread/treated thread from said thread treatment machine. One non-limiting example of such tension control mechanism is called dancer control. Such dancer control systems/units can provide accumulation or storage of material, such that when located between two driven sections of a process (i.e. the thread treatment machine and the thread applicator) that may accelerate or decelerate at different rates, the dancer can absorb or store excess material or give up stored material to provide a more stable operating tension level. Another dancer mechanism is a conventional gravity operated "swing arm" type dancer, in which the maximum storage equals the length of the thread required to drop the dancer from its highest possible position to its lowest possible position. The force exerted by a dancer system sets the tension in the zone where it is located, and enables the dancer to directly control the thread tension by using, e.g., adjustable weights, counter weights or pneumatically controlled actuators. Electrically controlled pneumatics can also be used.

In certain embodiments, the integrated system of the invention further comprises a buffering mechanism located between said thread treatment machine and said thread applicator for compensating of thread velocity between the thread treatment machine and the thread applicator.

When connecting a thread treatment machine to a thread applicator, such as an embroidery-, a sawing-, or a quilting machine, there is a need to compensate for thread velocity differences. In order to do so, buffer mechanism may be introduced in-between. The buffer mechanism functions by collecting treated thread when the velocity of the thread applicator is lower than the velocity of the thread treatment machine and by feeding the excess thread to the thread applicator when the application rate (e.g. stitching, sawing, embroidering, etc.) is higher than the thread treatment velocity.

According to some embodiments, the buffer mechanism is achieved by using dancer tension control system as described above, in which case said buffer mechanism and said tension control system constitute the same unit/system. In other cases, e.g. when there is a need to collect large amount of thread or a very long thread, a different method needs to take place.

Accordingly, in certain embodiments, the above buffering mechanism comprises of high stroke element that can be moved in a defined slot in order to extend or shorten the thread path along the system, i.e. between the thread treatment machine and the thread applicator.

According to other embodiments, the buffering mechanism comprises a winding system that collects the excess treated thread and then feeds forward said collected thread as needed.

According to some embodiments, the thread applicator comprises one of: stitching machine, three-dimensional (3D) printer.

According to some embodiments, the thread is adapted for the thread applicator use.

According to some embodiments, the thread treatment machine is configured to carry out at least one of the following treatment types: thread dyeing, applying at least one chemical material over the thread or portions thereof, thread curing, thread heating, thread coating, thread stretching.

According to some embodiments, the integrated system further comprises at least one detector for detecting thread related parameters and transmitting data indicative thereof to the control unit for having the control unit identify thread related defects and operating a repairing operation according to each identified defect. Optionally, repairing operations are carried out using predefined repairing protocols.

According to some embodiments, the at least one control unit is adapted for a specific thread applicator type and is configured for receiving thread treatment plans and controlling all integrated system controllable components for coordinating the thread treatment with the operation of the thread applicator.

According to some embodiments, the at least one control unit is adaptable to several types of thread applicators, the at least one control unit being configured to allow adjustment of the thread treatment and thread advancing to properties and definitions of the specific thread applicator type being used.

According to some embodiments, the integrated system further comprises at least one control panel, operatively associated with the at least one control unit, the control panel being adapted for receiving and outputting of data for having a user operating the integrated system and input adaptable definitions thereof for operating and controlling the components of the integrated system according to the input data and for outputting information relevant to the user. Optionally the control unit and control panel are further configured for providing user interfaces adapted to each specific application system being used and thread treatment.

The present invention further provides a method for treating threads and utilizing the treated thread comprising: providing at least one thread treatment machine each configured for treating the thread and at least one thread advancing mechanism for advancing the thread; directing the thread through the at least one thread treatment machine for treating portions thereof; collecting and trimming undesired thread portion edge; and directing the treated thread from the thread treatment machine to a thread applicator utilizing the treated thread while coordinating the operation of the thread treatment machine and the thread advancement therethrough and therefrom with the operation of the thread applicator.

According to some embodiments, the method further comprises tension controlling of the treated thread for maintaining tension thereof throughout its advancing path from the thread treatment machine to the thread applicator.

According to some embodiments, the method further comprises detecting thread related properties of passing portions of the treated thread for identifying thread related defects and repairing the detected defects by using one or more defect repairing protocols. Non-limiting examples of such repairing protocols are: (i) stopping the thread applicator and the thread treatment machine and/or the entire integrated system when the thread is torn; (ii) collecting and trimming inappropriate treated thread, while adjusting the treatment in the thread treatment machine; (iii) sounding an alarm and/or sending a message to the operator when a malfunction occurs; (iv) activating/deactivating a tension control unit according to need; etc.

The present invention additionally provides an integrated system for treating a thread and stitching therewith, the integrated system comprising a thread treatment machine for treating a thread or portions thereof; a stitching machine for making stitches using the treated thread; at least one mechanism for collecting and trimming thread portions; optionally, a buffering mechanism; and at least one control unit, each configured for controlling at least the thread treatment machine, the thread applicator and the collecting and trimming mechanism and for coordinating the treatment of the thread with the operation of the stitching machine, wherein the at least one control unit is further configured for controlling the collecting and trimming mechanism for collecting undesired, e.g. untreated, thread edge portions for allowing using only desired, e.g. treated, thread portion.

In certain embodiments, the system of the present invention further comprises a vision system to enable, e.g., the color identification of the embroidered fabric. Based on said color identification, the system will be able to match the color of the treated thread to the embroidered fabric. In other embodiments, said vision system constitutes part of the quality control system validating the outcome of the thread treatment. The vision system may comprise a camera, IR camera, spectrophotometer or any other vision sensors as required for controlling the quality of the treatment and also be supported with appropriate illumination such as LED, laser, or any other light source.

According to some embodiments, the integrated system further comprises a mechanism for detecting the number of stitches left to be carried out by the stitching machine for each treated thread portion and for controlling the collection, gripping and trimming mechanism after the final stitch is done for the respective treated thread portion. In a specific embodiment, said mechanism is said vision system or is a part thereof.

According to specific embodiments, the stitching machine is one of: a sewing machine, an embroidery machine, a quilting machine.

According to some embodiments, the control unit is further adapted to control a re-stitching process for compensating overlapping treated thread portions, according to the data from the treatment plan.

According to some embodiments, the control unit is further adapted to estimate the number of stitches required for each design part for the stitching machine and calculate the length of each thread portion to be treated according to the estimated stitches number.

According to some embodiments, the control unit is further adapted to estimate the length of remaining thread portion required by calculating the length already stitched according to the detected number of stiches and dividing the stitches remaining and estimating the thread on a real time and iterative base.

According to some embodiments, the stitching machine uses a single needle for stitching the treated thread.

According to some embodiments, the integrated system further comprises a tension control mechanism, located between the thread treatment machine and the stitching machine for maintaining tension of the thread while advanced between the thread treatment machine and the stitching machine. The tension control mechanism optionally comprises at least one weigh member through which the treated thread is passed the weigh member is adapted to displace itself according to access thread length.

According to some embodiments, the thread treatment machine is a dyeing machine for dyeing portions of thread in different colors according to a dyeing plan such that the control unit is set to receive the dyeing plan indicating the exact dyes mixture for each thread portion for controlling the dyeing machine thereby.

According to some embodiments the mechanism further comprises a holder extendible from the clamps for bringing the thread to the clamps for gripping thereof.

DETAILED DESCRIPTION OF SOME EMBODIMENTS OF THE INVENTION

Figure 1:
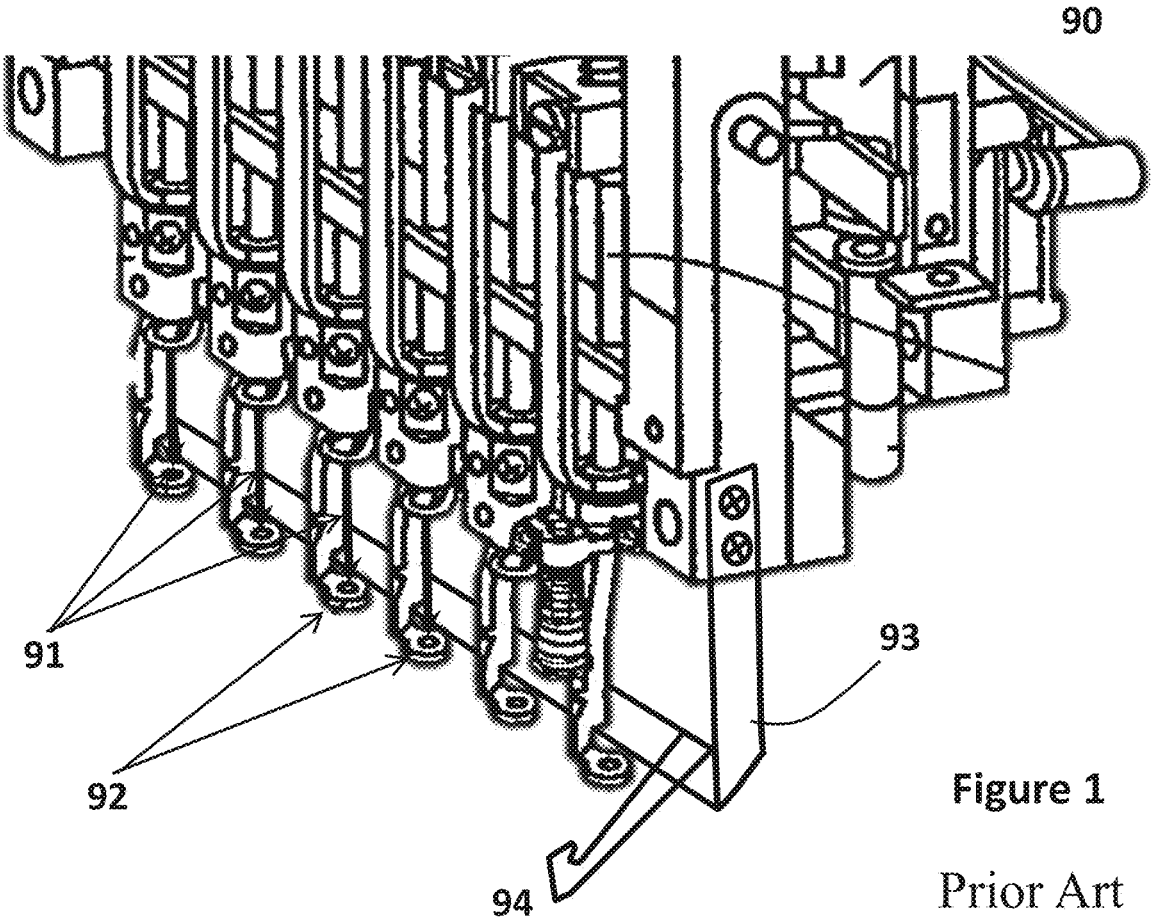
Figure 1 Prior Art
FIG. 1 schematically illustrates a part of a prior art industrial embroidery machine.
Figure 2:
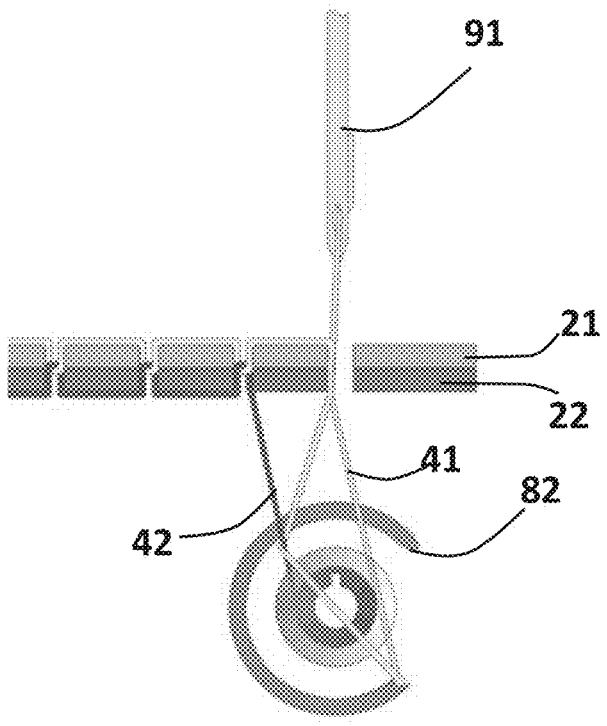
Figure 2 Prior Art
FIG. 2 shows a prior art bobbin for lock stitching.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention provides integrated systems and methods using thereof, for treating a thread or portions thereof and using the treated thread e.g. for stitching or three dimensional (3D) printing therewith in a combined manner such that the thread is treated and directed by a treatment machine of the system and directed to a thread applicator which utilizes in real time the treated thread. The integrated system comprises: a thread treatment machine for treating thread portions according to an input treatment plan; one or more thread directing and tension-control mechanisms at least for directing the treated thread from the thread treatment machine to a thread applicator, which utilizes the treated thread; a thread applicator using the treated thread and one or more control units each configured for controlling at least the thread treatment machine, the thread directing mechanism and for coordinating the advancement and treatment of the thread with the operation of the thread applicator. Optionally, the same central control unit controls the operation and coordination of all devices of the integrated system such as the treatment machine and thread applicator and devices designed for coordinating thereof and for directing the treated thread to the applicator. The integrated system also includes one or more devices or mechanisms for collecting untreated thread edge portions at the thread applicator for beginning the applicator's operation of utilizing the thread portions actually treated by the treatment machine.

The integrated systems of the present invention are configured such as to allow real time coordination between the treatment operation and the thread applicator operation and also for optionally responding in real time to events such as user input done during the operation of the integrated system or thread tearing events and the like. In this way thread portions can be treated and used e.g. for stitching or 3D printing therewith at the same timeframe without having to separate these two operations. The present invention also allows treating each thread portion differently and in real time according to system requirements depending also on the type of treatment machine being used.

The term "thread" used herein relates to any thread type known in the art such as filament, fiber, wire, cable, rope, flexible tube, yarn or an interwoven group thereof. The thread can be made of any known in the art thread material such as textile fibers e.g. cotton and/or polyester threads, nylon, polymer or silicone filament materials such as polyethylene, polyactic acid based filament and the like, metal cable or wire materials such as alloy and the like, rope materials such as plastic fibers and the like.

The term "stitching machine" used herein refers to any automated machine configured for producing thread stiches such as a sewing machine, a quilting machine, embroidery machine, knitting machine, weaving machine, and the like.

The thread treatment machine may be any machine known in the art that is configured to treat the thread or portions thereof using one or more treatment materials and/or devices such as for coating, chemically treating, dyeing, curing, heating threads or portions thereof, stretching the thread or portions thereof or a combination of treatment types such as dyeing, coating and curing and the like.

According to some embodiments, the treatment machine is configured to treat the thread, based on an input operational plan designed to control thread treatment related parameters such as dispensing treatment material amount, dispensing duration, curing duration and features (intensity and the like). The treatment machine for example is a thread dyeing machine for dyeing portions of threads in different color tones using input dyeing plan read and implemented by the dyeing machine, a machine that additionally or alternatively coats threads (e.g. by isolating, conductive or any other coating material) and/or chemically treating thereof.

According to some embodiments, the integrated system, comprising at least the thread treatment machine and a thread applicator that utilizes the treated thread in real time upon release thereof from the thread treatment machine; and a control unit configured for receiving data and controlling all devices, systems and machines of the integrated system in coordination therebetween, and optionally also in response to real time events occurring in the system such as tearing of the thread or in response to commands arriving from real time user input.

Optionally, the integrated system comprises a control panel associated with its one or more communication units for receiving input from users and for outputting data such as error messages, user manuals, system operational information and the like.

The thread treatment machine (also referred to herein shortly as "treatment machine") of the integrated system may be any machine that is configured for applying one or more treatment materials such as chemical materials, dyes, coating materials and the like, and/or for treating the thread by using treatment devices such as heaters or curing devices and the like.

For applying of treatment materials for having the thread absorbing thereof or for coating the thread, the treatment machine may include one or more injecting or spraying mechanisms comprising one or more injectors and treatment material cartridges controlled and operated automatically via a motorized system using one or more motors or drives and one or more power sources for enabling treating the thread and/or portions thereof, according to received input data.

According to some embodiments, the treatment machine is also configured for treating each thread portion differently, e.g. by dyeing each thread portion with a different mixture of dyes, for producing a multicolored thread to be used, e.g. by a stitching machine or 3D printer and the like.

According to some embodiments, the system also includes one or more tension control mechanisms for maintaining tension in the thread between the treatment machine and the thread applicator in a manner that may mechanically respond to changes in the thread tension. For example, the tension control mechanism includes a weight member connected to the thread in a manner that still allows the treated thread to pass therethrough such that the weight is displaceable in response to tension changes in the thread and environment parameters.

In some embodiments, the integrated system also includes one or more thread advancing mechanisms for pushing or pulling of the thread from the treatment machine towards the thread applicator or in case of a stitching machine applicator, for pulling the thread after the needle(s) thereof.

Figure 3:
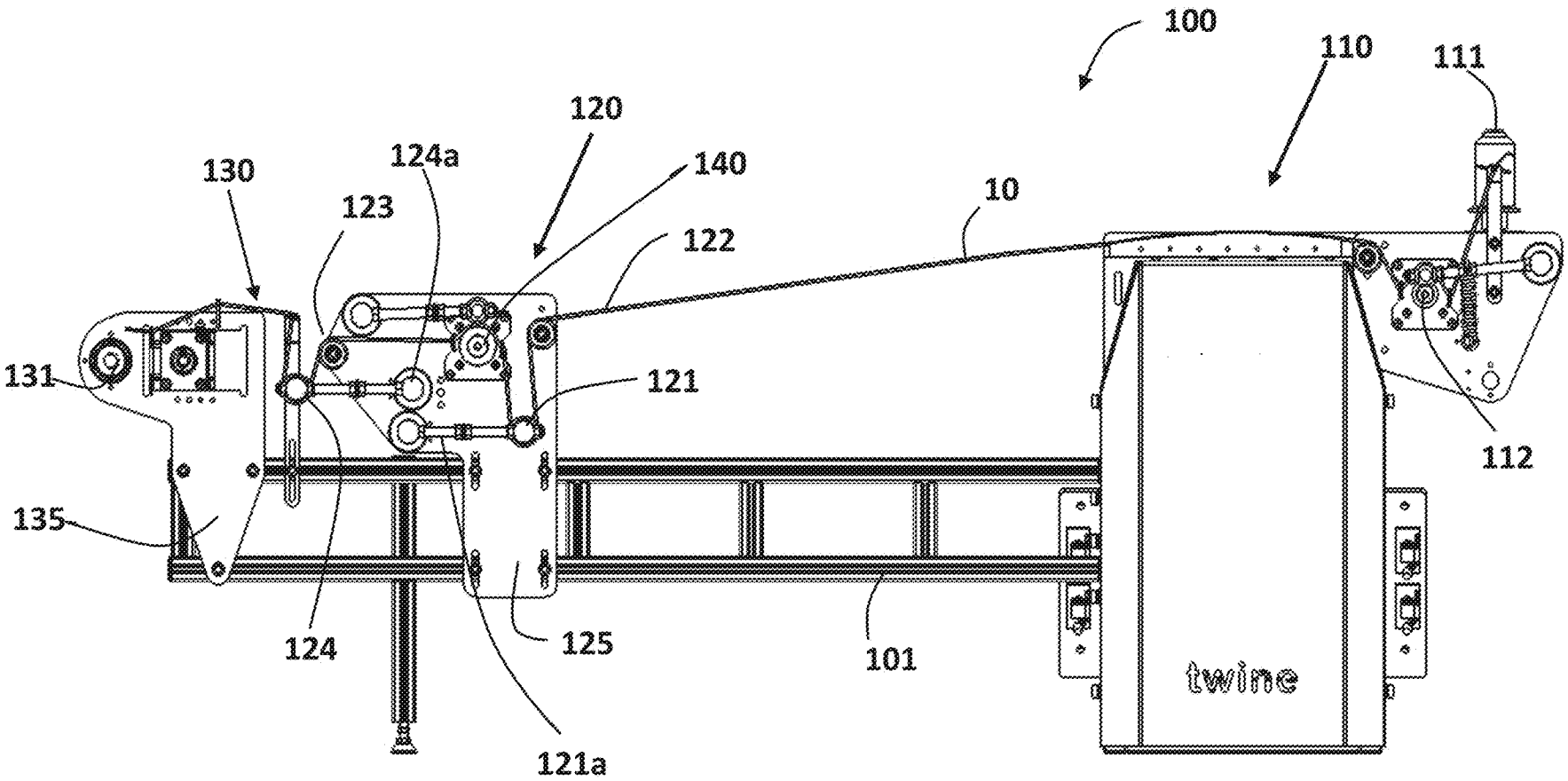
FIG. 3 shows an integrated thread treatment and thread utilization and after thread advancing system, wherein the system includes a tension control mechanism, according to some embodiments of the invention.

Reference is now made to FIG. 3 schematically illustrating an integrated system 100 including a thread treatment machine 110 and a thread applicator 130, according to some embodiments of the invention. The thread treatment machine 110 is configured for treating a thread or portions thereof e.g. by dyeing, curing and/or or coating thread portions. The thread treatment machine 110 uses a single thread spool 111 where the thread 10 thereof is directed towards the thread applicator 130 via one or more rollers such as roller 112, through one or more treatment devices (not shown) such as injector sets for injecting materials for applying thereof onto or into the thread portion passing thereover or there-below, and/or other treatment devices such as heaters, curing device(s) and the like. Each injector set may include an injector and a different cartridge containing the treatment material therein.

The treated thread 10 is then directed from the thread treatment machine 110 to the thread applicator 130 through a tension control unit 120 having one or more tension control mechanisms each comprising a weight member such as weight members 121 and 124 each pivotally connecting to a holding platform 125 of the tension control unit 120 via a fixation member such as hinge 121*a* and 124*a*, respectively. Each weight member 121/124 is configured as a circular track over which the thread 10 can be passed, where the weight member 121/124 responds to tension changes in the treated thread 10 such that when the tension reduces the weight member 121/124 will automatically and mechanically be vertically displaced by rotation thereof about its hinge connector 121*a*/124*a* since gravitation will exceed the opposing tension force. The tension control unit 120 may also include one or more rollers such as roller 122 and 123 for directing the treated thread 10 to and from the weight members' 121 and 124.

According to some embodiments, potentiometers or other sensors may be used for gouging the thread tension and optionally for electrically controlling the weight members 121 and 124 displacement.

According to some embodiments, as illustrated in FIG. 3, another thread advancing mechanism 140 may be used for directing the thread 10 thereby. The thread applicator 130 is very schematically illustrated as having a holding platform 135 and a spooling drive shaft 131 that can be operated via a motor for rotating thereof for winding the treated thread 10 thereover. However, any thread applicator may be used for using the treated thread 10 in any manner e.g. for stitching or 3D printing therewith and the like.

The control unit (not shown) of the integrated system 100 according to the invention may be configured for receiving machine-readable treatment plans data, indicative of how thread portions are to be treated. The control unit may also be adaptable to operate and coordinate the operation of more than one type of thread treatment machines and thread applicators. The control unit may further be configured for controlling the thread treatment according to the operation of the thread applicator 130. In some embodiments, the control unit may also adapt the operation of the thread treatment machine 110 in response to real time events relating to the thread applicator 130 and data obtained by sensors of the integrated system 100 such as thread tearing or operational commands inputted by the user during operation of the system 100.

According to some embodiments, the integrated system 100 uses a motor (not shown) and a power source (not shown) for operating thereof. The advancement of the thread through the thread treatment machine 110 may be achieved by having one or more advancement mechanisms in the thread applicator 130 or in the thread treatment machine 110, such as one or more coordinated drive shafts for pulling the thread for advancing thereof located, e.g., after the thread treatment machine 110. In another configuration, i.e., in the case of a stitching machine applicator, the needle displacement will advance the thread also from its original spool in the thread treatment machine 110.

According to some embodiments, all electronically controlled devices of the integrated system 100 such as the treatment devices of the thread treatment machine 110 and the thread applicator 130 devices are operable via a single motor, power source and a control unit, and may also share a single thread advancing mechanism.

According to some embodiments, at least the thread treatment machine 110 and tension control unit 120 are supported by a supporting apparatus 101 holding at least parts thereof.

Figure 4:
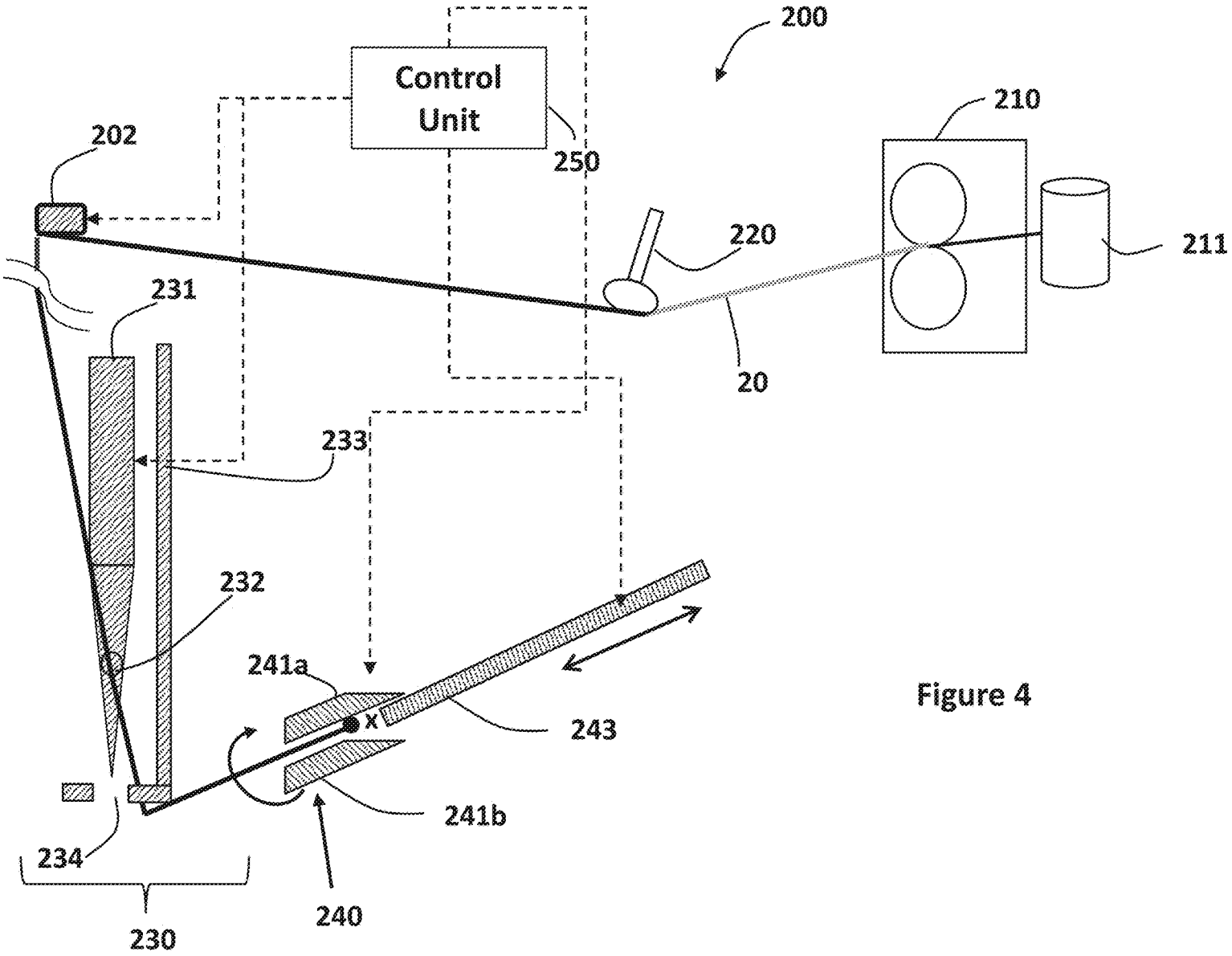
FIG. 4 shows an integrated system for treating a thread e.g. by dyeing thereof and utilizing the treated thread, wherein the system includes a collector for pre-stitching collection of untreated thread portions, according to some embodiments of the invention.

Reference is now made to FIG. 4 schematically illustrating an integrated system 200 for thread treating, directing and utilizing, according to some embodiments of the invention. In this configuration, the integrated system 200 comprises a thread treatment machine 210 and a single-needle stitching machine 230 such as an embroidery machine or a sewing machine as the thread applicator, utilizing the treated thread arriving from the treatment machine 210. In this case, a thread 20 is directed through the thread treatment machine 210 for treatment of portions thereof and the treated thread 20 is directed to the stitching machine 230 of the integrated system 200 via one or more tension control mechanisms such as tension control unit 220.

As illustrated in FIG. 4, the stitching machine 230 includes a single needle 231 having a needle hole 232 through which the treated thread 20 is threaded for utilizing thereof for stitching; and a foot 233 having an opening 234 for allowing the threaded needle 231 to be vertically displaced therethrough for the stitching.

The integrated system 200 also includes a novel gripping and collecting member 240 having two clamps 241*a* and 241*b* similar in design to clamps shown in FIG. 1 for member 93, e.g. by having VELCRO™ attaching strips thereover for gripping on to the thread. The gripping and collecting member 240 is placed after the thread needle 231. The gripping and collecting member 240 is not stationary in this case but operable via a motor (not shown) and rotatable about an axis "x" for pulling the thread for the collection thereof.

A holder member 243, designed similarly to the hooked member 94 shown in FIG. 1, extendable from the gripping and collecting member 240, is configured for gripping the thread 20 and placing it between the two clamps 241*a* and 241*b* of the griping and collecting member 240. To do that, the holder member 243 is displaceable by the same or a different motor (not shown) and controllable by the control unit 250.

According to some embodiments, the gripping and collecting member 240 is designed for a pre-stitching collection of thread edge portion that is untreated for allowing beginning the stitching only with the rightly treated thread portions. These untreated edge thread portion will be collected by the gripping and collecting member 240 and trimmed by the stitching machine trimmer located in the bobbin area (not shown) in the beginning of each operation session. The collection and trimming process can also be initiated during (i.e. in the middle of) the system 200 operation for collecting and trimming off defected thread portions.

As illustrated in FIG. 4, the integrated system 200 may comprise a single control unit 250 for receiving and processing input data such as treatment plans and stitching machine operational data, and operating the stitching machine 230 and the thread treatment machine 210 as well as all other devices in the system 200, such as thread collection and trimming by controlling the collection member 240 operation. The devices and machines of the system 200 are operated by such a control unit 250 in a coordinated manner according to the received data based on predefined algorithms and operational rules and commands. The control unit 250 may be also operatively associated with one or more control panels such as a combined control panel enabling users to input operational setup data for each of the treatment and stitching machines 210 and 230, respectively, and for inputting operational commands for controlling the system 200 during operation thereof (e.g. enabling terminating the system's operation during operation thereof).

According to some embodiments, the integrated system 200 includes one or more sensors such as potentiometer 202 for sensing thread tension, for instance for identification of thread tearing (e.g. after the needle 231), or an optical detector for detecting treatment related defects in the treated thread 20. In case of defect detection (e.g. thread tearing after the needle 231 or treatment related defects), the control unit 250 may terminate the treatment and thread directing operation for a short time-interval and collect the defected thread portion using the collecting member 240 and trim the defected collected thread portion using the trimmer of the stitching machine 230.

According to other embodiments, the thread applicator is a 3D printer, wherein the treatment machine treats filament threads adapted to be used as raw material for 3d printing.

According to some embodiments, one or more sensors used by the integrated system is adapted to sense treatment related parameters and send data of the sensed parameters to the control unit 250 such as to allow the control unit to detect thread related defects such as treatment related defects or tearing of the thread and the like and optionally adapt system operation according to the detected defect, e.g. by using defect events protocols.

In some embodiments, as mentioned above, the treatment machine is a dyeing machine capable of dyeing a thread with multiple color tones such that each thread portion can be dyed with a different color mixture by injecting thereover different portions and dyes. In this case the integrated system of the present invention uses one or more sensors thereof for detecting coloration defects, in which case the defect event protocols may include trimming and collection of thread portions that do not contain the right coloration or over-stitching in which the fabric passed through the stitching machine is remained in position to allow stitching over the defected area.

According to some embodiments of the invention, other sensors can be used for counting or estimating the number of stitches performed e.g. for embroidery stitching machines. The control unit uses this estimation for programing the thread portions to be dyed in each color tone according to the input coloration plan as well as according to a calculated number of the remaining stitches to be done.

Therefore the integrated system has mechanisms for defect detection and mitigation operational protocols allowing optimizing the coordination between the machines as well as saving of machine operation time and raw materials e.g. by collecting and trimming of the defected thread portions and optionally re-stitching over defected areas already stitched and the like.

Figure 5:
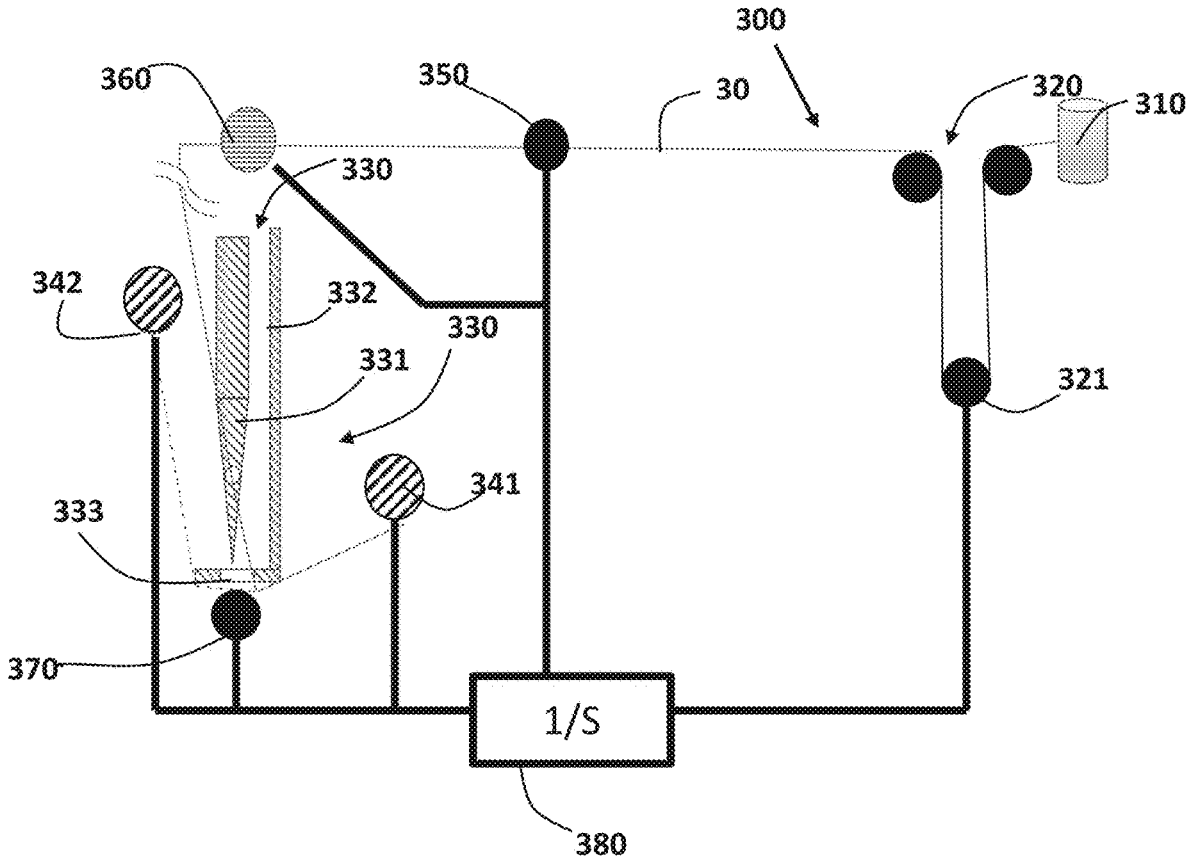
FIG. 5 shows a schema of an integrated system for treating a thread and utilizing the treated thread having the tension control mechanism and the pre-stitching mechanism integrated therein, according to some embodiments of the invention.

Reference is now made to FIG. 5, showing a schema of an integrated system 300, according to other embodiments of the invention. This system 300 includes a thread treatment machine 310, a tension control unit 320 with a weight member 321, a stitching machine 330, two rotatable collecting members 341 and 342 and detectors 350, 360 and 370 for detecting thread tearing (detector 360), counting remaining stiches number (encoder detector 350) and detecting treatment related defects (optical sensor or detector 370). The thread 30 is directed through the thread treatment machine 310 for being treated and the treated thread 30 is then advanced to the stitching machine 330 via the tension control unit 320 and the encoder 350 and thread tension (tearing) detector 360.

The stitching machine 330 is similar to the stitching machine 230 having a foot 332 with an opening 333 for allowing the displaced needle 331 to penetrate therethrough in the stitching process. A central control unit 380 communicates and controls operation of all components of the system 310, 320, 330, 341, 342, 350, 360 and 370.

Figure 6A:
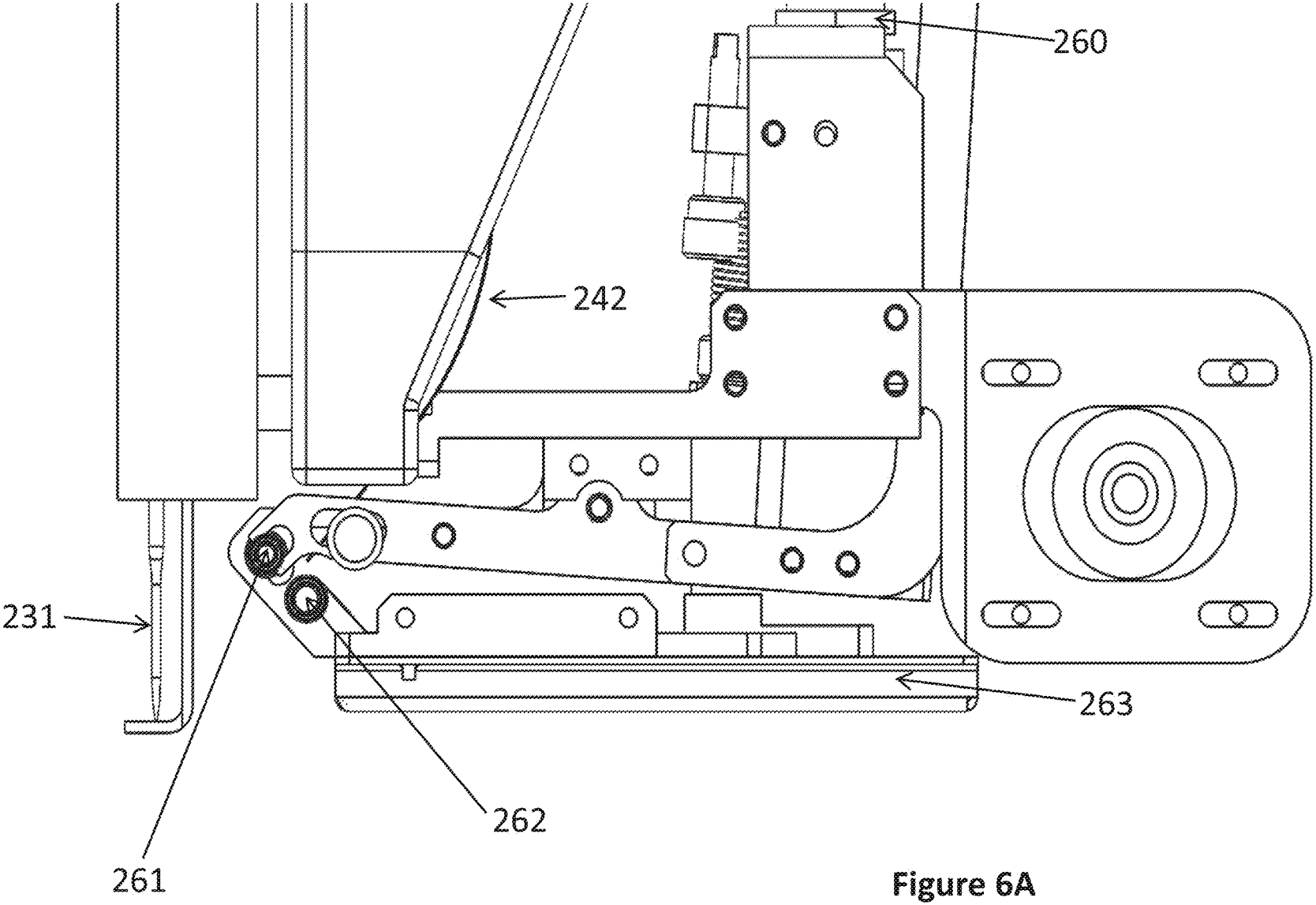
FIGS. 6A and 6B are schemes illustrating a thread collecting mechanism, wherein the rollers are disengaged (7A) or engaged (7B).
Figure 6B:
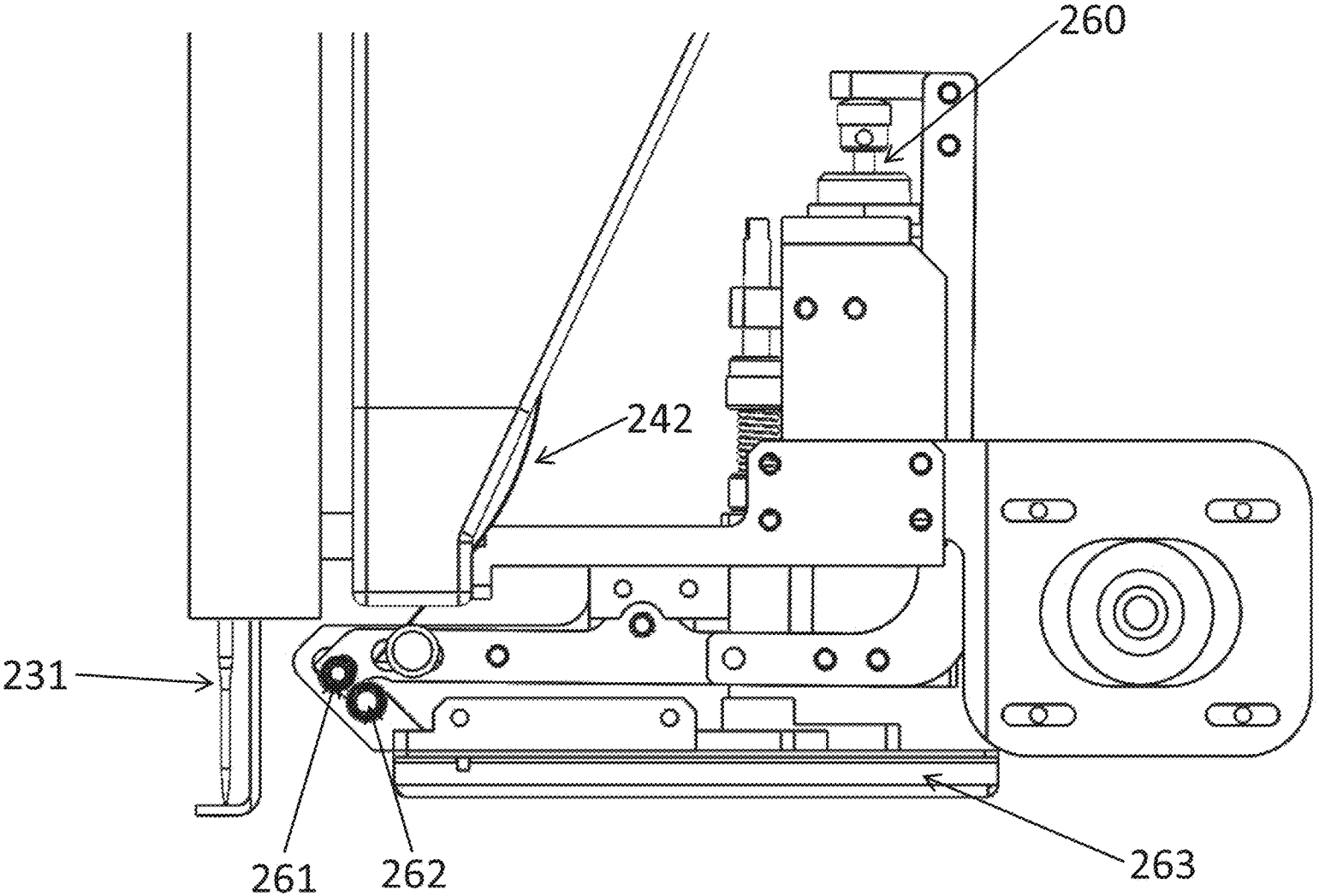

Reference is now made to FIGS. 6A and 6B, illustrating another embodiment of a thread collecting mechanism according to the invention. In this configuration, the thread collecting mechanism comprises two rollers: a driven roller 261 and a driving 262 which hold the thread in-between and pull it as they twist and turn. An actuator 260 shifts one of the rollers away from the other, e.g. the driven roller 261 away from the driving roller 262, to thereby enable a hook 242 to pass between the two rollers, grab the thread and pull it in between the two rollers. Said hook 242 is activated to pass between the two rollers, approach and grab the thread, and return back while pulling the thread between the two rollers. Once the hook 242 returns, the actuator 260 then shifts the roller back against the other roller, e.g. the driven roller 261 against the driving roller 262, thereby enabling holding the thread in between the two rollers. It should be noted that the actuator 260 may also be configured to move any one of the two rollers or both. After the two rollers are in place holding the thread, the driving roller 262 is activated to turn, causing the thread to be pulled back and collected, e.g., in a specific collecting tray 263.

Figure 7:
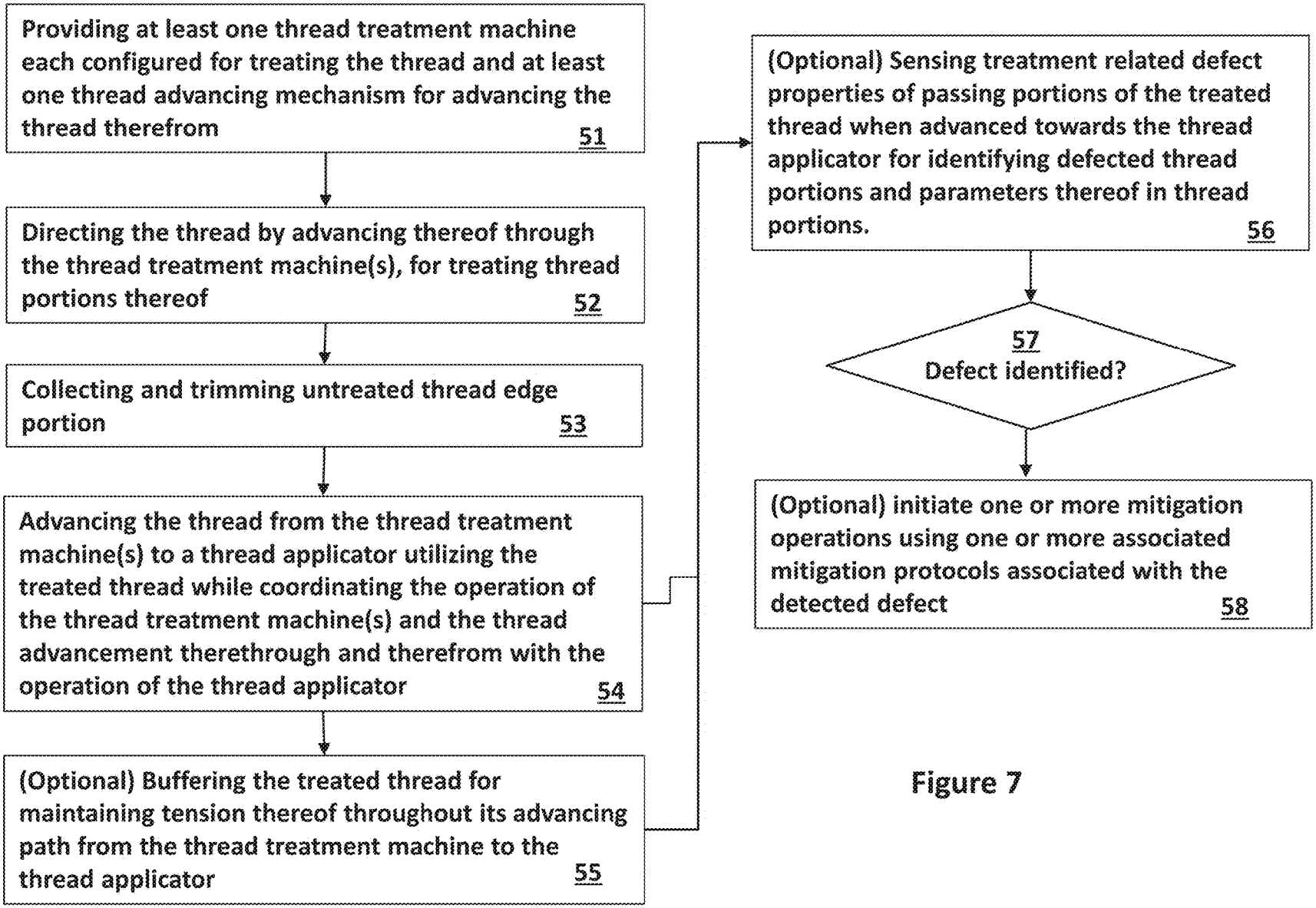
FIG. 7 is a schema illustrating a process for thread treatment, advancing and coordinating with a thread applicator, according to some embodiments of the invention.

Reference is now made to FIG. 7, which is a flowchart schematically illustrating a process for treating a thread and advancing thereof to be used by a thread applicator, according to some embodiments of the invention.

The process includes: (i) providing at least one thread treatment machine configured for treating the thread and at least one thread applicator for using the treated thread 51; (ii) directing the thread through the thread treatment machine for treating the thread or portions thereof 52; (iii) collecting and trimming untreated thread portion edges 53 or undesired/defective portions of the treated thread; (iv) directing the thread from the thread treatment machine to the thread applicator utilizing the treated thread while coordinating the operation of the thread treatment machine and the operation of the thread applicator 54.

The process may also involve one or more of the following steps: (a) tension controlling of the treated thread for maintaining tension thereof throughout its path from the thread treatment machine to the thread applicator 55; and (b) sensing treatment related properties of passing portions of the treated thread when advanced towards the thread applicator for identifying defected thread portions and parameters thereof 56-57 and mitigating or repairing the detected defects by using one or more defect mitigation protocols stored in the control unit of the system 58.

Many alterations and modifications may be made by those having ordinary skill in the art without departing from the spirit and scope of the invention. Therefore, it must be understood that the illustrated embodiment has been set forth only for purpose of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

What is claimed is:

1. An integrated system for treating a single thread and using the treated thread, said integrated system comprising:

a) a thread treatment machine for treating said single thread or portions thereof;

b) a thread applicator configured for using the treated thread;

c) at least one mechanism for collecting and trimming thread portions; and d) a control unit configured for controlling the thread treatment machine, the thread applicator, and the collecting and trimming mechanism, wherein:

said thread treatment machine is adapted for applying more than one different chemical materials over the thread or portions thereof while the thread passes through;

said control unit is configured for receiving thread treatment plans for coordinating thread treatment with the operation of the thread applicator, and for controlling the collecting and trimming mechanism for collecting undesired thread edge portions for allowing using only desired thread portions; and each of said at least one mechanism for collecting and trimming edges of the treated thread comprises:

a gripping and collecting member and a trimmer, said gripping and collecting member being configured to grab and collect the thread by having: (a) a clamp for gripping the thread therebetween and rotating about an axis thereof for collecting the thread by winding thereof, or (b) parallel collecting rollers working against each other in order to pull the thread; and a motor configured for: rotating said clamp or said parallel collecting rollers for collecting the thread.

2. The integrated system according to claim 1 further comprising at least one tension control mechanism configured for maintaining tension in the thread after the thread has been treated and directed towards the thread applicator, wherein said at least one tension control mechanism comprises at least one force applying unit pivotally connected to a fixation member, said at least one force applying unit being located such that the thread is held thereby such that when tension in the thread reduces, the thread is pulled for maintaining the tension in the thread above a minimum threshold.

3. The integrated system according to claim 1 further comprising a buffering mechanism located between said thread treatment machine and said thread applicator for compensating any difference between thread velocity between the thread treatment machine and the thread applicator.

4. The integrated system according to claim 1, wherein said thread treatment machine is configured to carry out thread dyeing, and at least one of the following treatment types: thread curing, thread heating, thread coating, thread stretching.

5. The integrated system according to claim 1 further comprising at least one optical detector for detecting thread related parameters and transmitting data indicative thereof to said control unit for having said control unit identify thread related defects and operating a repairing protocol according to each identified defect, wherein said repairing protocol is collecting and trimming inappropriate treated-thread portions, while adjusting a treatment carried out by in the thread treatment machine; and optionally re-applying new treated-thread over areas where defect-thread was applied.

6. The integrated system of claim 1 for treating a thread, wherein:

said using the treated thread means stitching therewith;

said thread applicator is a stitching machine for making stitches using the treated thread; and said control unit is configured for: (i) controlling the thread treatment machine, the stitching machine, the collecting and trimming mechanism for collecting undesired thread edge portions for allowing using only desired thread portion, and a re-stitching process for compensating overlapping treated thread portions, according to the data from the treatment plan, or any combination thereof, and (ii) coordinating treatment of the thread with operation of the stitching machine.

7. The integrated system according to claim 6 further comprising a mechanism for detecting the number of stitches left to be carried out by the stitching machine for each treated thread portion and for controlling the collecting and trimming mechanism after a final stitch is done for each respective treated thread portion.

8. The integrated system according to claim 6, wherein said control unit is further adapted to: estimate a number of stitches required for each design part for the stitching machine and calculate a length of each thread portion to be treated according to the estimated stitches number, and optionally to estimate the length of remaining thread portion required by calculating the length already stitched according to the detected number of stiches and dividing the stitches remaining and estimating the thread on a real time and iterative base.

9. The integrated system according to claim 6, wherein said stitching machine uses a single needle for stitching said treated thread.

10. The system according to claim 6 further comprising a tension control mechanism located between said thread treatment machine and said stitching machine for maintaining tension of the thread while advanced between the thread treatment machine and the stitching machine, wherein said tension control mechanism comprises at least one weight member through which the treated thread is passed, said weight member is adapted to displace itself according to access thread length.

11. The integrated system according to claim 6, wherein said thread treatment machine is a dyeing machine for dyeing said thread or portions thereof in different colors according to a dyeing plan such that the control unit is set to receive the dyeing plan indicating exact dyes mixture for each thread portion for controlling the dyeing machine thereby.

12. The integrated system of claim 1 for treating a thread, wherein said using the treated thread means embroidering therewith;

said thread applicator is an embroidery machine for embroidering using the treated thread; and said control unit is configured for: (i) controlling the thread treatment machine, the embroidery machine, the collecting and trimming mechanism for collecting undesired thread edge portions for allowing using only desired thread portion, and a re-stitching process for compensating overlapping treated thread portions, according to the data from the treatment plan, or any combination thereof, and (ii) for coordinating treatment of the thread with operation of the embroidery machine.

13. The integrated system according to claim 1, wherein said mechanism for collecting and trimming thread edges further comprises:

a holder or hook extendible from said clamp or said rollers for bringing the thread to the clamp or rollers for gripping thereof.

14. The integrated system of claim 1 for treating a thread, wherein:

said using the treated thread means knitting;

said thread applicator is a knitting machine for knitting using the treated thread; and said control unit is configured for: (i) controlling the thread treatment machine, the knitting machine, the collecting and trimming mechanism for collecting undesired thread edge portions for allowing using only desired thread portion, and a re-stitching process for compensating overlapping treated thread portions, according to the data from the treatment plan, or any combination thereof, and (ii) coordinating treatment of the thread with operation of the knitting machine.

* * * * *